United States Patent [19]

Poulton et al.

[11] Patent Number: 4,606,280

[45] Date of Patent: Aug. 19, 1986

[54] ONE PIECE SHELF EXTENDER

[75] Inventors: Brent Poulton, 18 Crawford Ct., Santa Rosa, Calif. 95401; Benjamin L. Garfinkle, Lafayette, Calif.

[73] Assignee: Brent Poulton, Santa Rosa, Calif.

[21] Appl. No.: 764,563

[22] Filed: Aug. 12, 1985

[51] Int. Cl.[4] ..... A47B 57/00

[52] U.S. Cl. ..... 108/97; 108/65; 108/152

[58] Field of Search ..... 108/97, 65, 67, 69, 108/90, 152; 312/234.4, 281; 248/225.1, 221.4; 211/86, 90

[56] References Cited

U.S. PATENT DOCUMENTS

| | | | |
|---|---|---|---|
| 399,266 | 3/1889 | Hull | 312/281 X |
| 2,590,793 | 3/1952 | Rigstad | 312/281 X |
| 2,914,191 | 11/1954 | Bowden et al. | 211/153 |
| 3,193,108 | 7/1965 | Johnson | 211/153 |
| 3,289,615 | 12/1966 | Marschak | 108/97 |
| 3,647,078 | 3/1972 | Fortunato | 211/134 |
| 4,088,081 | 5/1978 | D'Arca | 108/97 X |
| 4,125,840 | 8/1978 | Babberl | 248/221.4 |
| 4,140,224 | 2/1979 | Celeste | 211/134 |
| 4,375,880 | 3/1983 | Sinclair | 248/225.1 |
| 4,426,797 | 1/1984 | Burkemper et al. | 40/16.4 |

*Primary Examiner*—William E. Lyddane
*Assistant Examiner*—José V. Chen
*Attorney, Agent, or Firm*—David C. Ripma

[57] ABSTRACT

A unitary, one-piece shelf extender is provided which can conveniently be extruded. The shelf extender includes means for clipping onto a price or display tag holder on the leading edge of a shelf. The shelf extender includes a separate tag holder on its forward edge.

13 Claims, 3 Drawing Figures

ONE PIECE SHELF EXTENDER

BACKGROUND OF THE INVENTION

The invention relates generally to detachable shelf extenders for extending forward from the leading edge of a display shelf.

Shelf extenders are a useful merchandising tool which can highlight particular products on a crowded shelf. As used here, the term shelf extender refers to a device which projects outwardly from the forward or leading edge of a shelf. A shelf extender will usually project outwardly only a few inches, providing enough room to support a small item such as might be found in a supermarket. In general, shelf extenders should be easy to install and detach from the shelf to permit flexibility in merchandising and should be sturdy and secure. Examples of prior art shelf extenders can be found in U.S. Pat. Nos. 2,914,191; 3,193,108; 3,289,615 and 3,647,078.

Prior art shelf extenders are generally formed either of numerous parts, requiring assembly, or have metal frames or other parts which require relatively expensive fabrication. It would be advantageous to have a shelf extender which can be conveniently and inexpensively manufactured by extrusion. It would also be advantageous to have a shelf extender which can be easily made in various sizes to accommodate selected merchandise of differing sizes.

SUMMARY OF THE INVENTION

Accordingly, a shelf extender means is provided for attachment to a shelf having a top surface extending forward to a leading edge and having a forwardly facing channel along the leading edge which includes at least two parallel inwardly turning lips. The shelf extender comprises a generally rectangular plate having forward and rear parallel edges along two sides of the rectangle and having a relatively flat upper surface for supporting objects when the shelf extender is in place on a shelf. On its lower surface, the plate includes first and second ribs projecting from the lower surface and extending parallel to the forward and rear edges between the first and second edges. The first rib is closest to the forward edge and extends angularly from the lower surface of the plate toward the rear edge. The second rib extends from the lower surface a distance shorter than the first rib. The first rib terminates in a first lip which projects generally toward the forward edge and the second rib terminates in a second lip projecting generally toward the rear edge. The first and second lips cooperatively engage the inwardly turning lips of the forwardly facing channel on a shelf, and the portion of the plate between the second rib and the rear edge rests on the top surface of the shelf, when the extender is attached to a shelf. The shelf extender can be conveniently extruded in one piece.

DETAILED DESCRIPTION OF THE INVENTION

Figure 1:
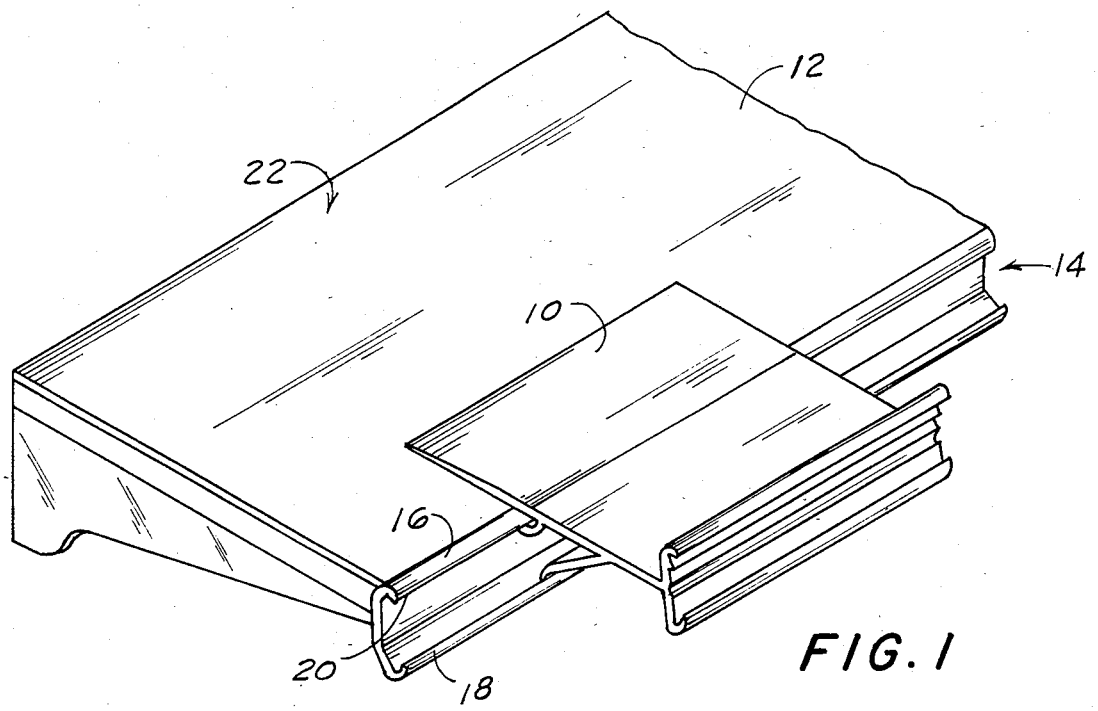
FIG. 1 is a perspective view of a shelf extender according to the present invention, in place on a shelf.
Figure 3:
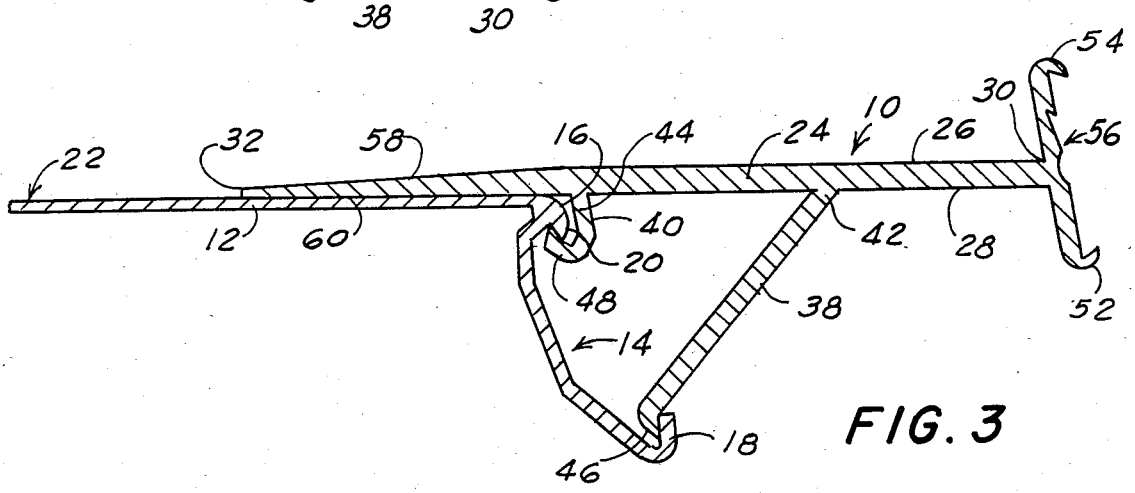
FIG. 3 is a side cross sectional view on a larger scale of the shelf extender and shelf of FIG. 1.

Referring to FIG. 1, a detachable shelf extender 10 according to the present invention is shown in place on a conventional supermarket or other display-type shelf 12. Referring also to FIG. 3, shelf 12 includes a forwardly facing channel 14 along its leading edge 16 for holding price or display tags or the like. Such a channel 14 will generally include at least two parallel inwardly turning lips 18 and 20 which form a recess in which tags are retained. The top surface 22 of the shelf is where merchandise is stored or displayed.

Figure 2:
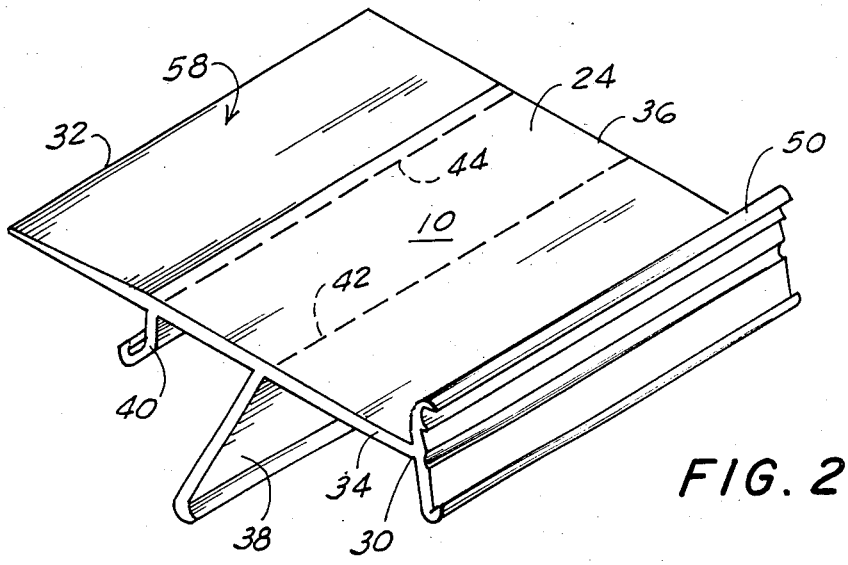
FIG. 2 is an enlarged perspective view of the shelf extender of FIG. 1.

Referring to FIGS. 2 and 3, the shelf extender 10 is in the form of a generally rectangular plate 24 having upper and lower surfaces 26 and 28, respectively. The upper surface 26 is relatively flat for supporting objects when the shelf extender is in place on a shelf. Parallel forward and rear edges 30 and 32, respectively, form two sides of plate 24. The other two sides of the plate are referred to as first and second side edges, 34 and 36, respectively.

The lower surface 28 of plate 24 includes a pair of elongated ridges or ribs extending downwardly when the extender is in place on a shelf. First rib 38 is closest to forward edge 30 and second rib 40 is closest to rear edge 32. First rib 38 extends from a line located approximately midway between the forward and rear edges of the plate. Ribs 38 and 40 extend longitudinally between the first and second side edges 34 and 36, parallel to the forward and rear edges of the plate. First rib 38 is in the form of an angular projecting plate which joins plate 24 along a line 42. Second rib 40 extends from lower plate surface 28 nearly perpendicularly from the plate. The second rib 40 extends a shorter distance from the lower surface than first rib 38, and joins plate 24 along line 44. First rib 38 terminates at its lower end in a first lip 46 which projects generally toward the forward edge of the plate. Second rib 40 terminates at its lower end in a second lip 48 projecting generally toward the rear edge of the plate. First and second lips 46 and 48 are designed to cooperatively engage the inwardly turning lips 18 and 20, respectively, of the display channel 14 on shelf 12, in the manner shown in FIGS. 1 and 3.

Shelf extender 10 preferably includes a tag holder means 50 extending along the forward edge 30 of the plate 24 for holding price or display tags. As shown, tag holder 50 is in the form of a ridge extending above upper surface 26 and below lower surface 28 of plate 24, between side edges 34 and 36. A pair of ribs 52 and 54 extend outwardly to form a concavity 56 which opens outwardly from forward edge 30 to receive display or price tags.

At the rear of the plate, the upper surface 26 tapers downwardly toward the lower surface in the region 58 generally rearward of second rib 40 near rear edge 32. The taper provides a relatively gentle transition between the shelf and extender so goods resting on both the shelf and extender will be on a relatively level surface. On the lower side of the tapered portion, rear of second rib 40, is a shelf engaging surface 60, which cooperates with ribs 38 and 40 to hold the shelf extender in place on a shelf.

To install extender 10 on a shelf, lips 46 and 48 on ribs 38 and 40, respectively, are engaged with lips 18 and 20 of shelf display channel 14. Rib 38 can be compressed slightly toward the plate to provide clearance so the lips will interlock. Shelf engaging surface 60 will then rest on the top surface 22 of shelf 12. Removal is simply a reversal of the process. Once in place, the shelf extender will be securely locked to the shelf.

Shelf extender 10 is preferably of a unitary, one-piece construction and is designed to be conveniently and effeciently extruded. The shelf extender, including the projecting ribs and tag holder, has an identical cross section along any line running perpendicular to the forward and rear edges of plate 24. Esch such cross section will look like the cross section of FIG. 3. As such, it can be extruded in a direction extending outwardly from the side edges in any convenient length. Individual extenders of any selected size can then be formed by cutting the extruded shelving material to the desired length. Any suitable extrudable material, such as plastic, can be used for the extenders. As such, the extenders are very inexpensive to produce.

The present invention provides a shelf extender which is easy to install and remove, sturdy and inexpensive. Fabrication costs are reduced to a minimum, yet the resulting product is attractive and highly functional. The extender can be used on metal or wood shelves of any thickness, as long as the shelf has a tag holder along its leading edge. The extender can conveniently be made in various lengths to accommodate merchandise of different sizes.

What is claimed is:

1. Shelf extender means for attachment to a shelf having a top surface extending forward to a leading edge and a forwardly facing channel along the leading edge which includes at least two parallel inwardly turning lips, the shelf extender comprising: a generally rectangular plate having forward and rear parallel edges along two sides of the rectangle and first and second side edges along the other two sides of the rectangle and having a relatively flat upper surface for supporting objects when the shelf extender is in place on a shelf, the lower surface of said plate including first and second ribs projecting from said lower surface extending parallel to said forward and rear edges between said first and second edges, said first rib being closest to said forward edge and extending angularly from said lower surface toward said rear edge and said second rib extending from said lower surface a distance shorter than said first rib, said first rib terminating in a first lip projecting generally toward said forward edge and said second rib terminating in a second lip projecting generally toward said rear edge such that said first and second lips will cooperatively engage the inwardly turning lips of the forwardly facing channel on a shelf and the portion of said plate between said second rib and said rear edge rests on the top surface of a shelf when the shelf extender means is attached to a shelf.

2. Shelf extender means as in claim 1 including tag holder means along said forward edge of said plate for holding display tags.

3. Shelf extender means as in claim 2 in which said tag holder means includes a ridge on said forward edge extending above said upper surface and below said lower surface between said first and second side edges of said plate.

4. Shelf extender means as in claim 1 in which said shelf extender means is of unitary construction formed of a continuous piece of extrudable material.

5. Shelf extender means as in claim 4 in which cross sections taken along lines running perpendicular to said forward and rear edges are identical for each such cross section of said shelf extender means, thereby permitting extrusion of said shelf extender means.

6. Shelf extender means as in claim 1 in which said first rib is approximately midway between said forward and rear edges of said plate.

7. Shelf extender means as in claim 1 in which said upper surface tapers toward said lower surface near said rear edge of said plate.

8. Shelf extender means for attachment to a shelf having a top surface extending forward to a leading edge and a forwardly facing channel along the leading edge which includes at least two parallel inwardly turning lips, said shelf extender means comprising: a generally rectangular plate having forward and rear parallel edges along two sides of the rectangle and first and second side edges along the other two sides of the rectangle and having a relatively flat upper surface for supporting objects when the shelf extender means is in place on a shelf, the lower surface of said plate including first and second ribs projecting from said lower surface extending parallel to said forward and rear edges between said first and second edges, said first rib being closest to said forward edge and extending angularly from said lower surface toward said rear edge and said second rib extending from said lower surface a distance shorter than said first rib, said first rib terminating in a first lip projecting generally toward said forward edge and said second rib terminating in a second lip projecting generally toward said rear edge, said shelf extender means being of unitary construction formed of a continuous piece of extrudable material and having identical cross sections everywhere taken along lines running perpendicular to said forward and rear edges to facilitate extrusion, said shelf extender means being installed on a shelf by said first and second lips cooperatively engaging the inwardly turning lips of the forwardly facing channel on a shelf with the portion of said plate between said second rib and said rear edge resting on the top surface of the shelf.

9. Shelf extender means as in claim 8 including tag holder means along said forward edge for holding display tags, said tag holder means being unitary with the rest of said shelf extender means.

10. Shelf extender means as in claim 9 in which said tag holder means includes a concavity opening outwardly from said forward edge to receive display tags thereon.

11. Shelf extender means as in claim 8 in which said first rib is approximately midway between said forward and rear edges of said plate.

12. Shelf extender means as in claim 8 in which said upper surface tapers toward said lower surface near said rear edge of said plate.

13. Shelf extender means as in claim 8 in which said shelf extender means is formed of a unitary piece of plastic.

* * * * *